US009250009B2

(12) United States Patent
Kentner et al.

(10) Patent No.: US 9,250,009 B2
(45) Date of Patent: Feb. 2, 2016

(54) REFRIGERATOR WITH FRAMED DOOR

(75) Inventors: Wolfgang Kentner, Röfingen (DE); Karl-Friedrich Laible, Langenau (DE)

(73) Assignee: BSH Hausgeräte GmbH, Munich (DE)

( * ) Notice: Subject to any disclaimer, the term of this patent is extended or adjusted under 35 U.S.C. 154(b) by 370 days.

(21) Appl. No.: 12/386,318

(22) Filed: Apr. 16, 2009

(65) Prior Publication Data

US 2009/0261703 A1 Oct. 22, 2009

(30) Foreign Application Priority Data

Apr. 17, 2008 (DE) ..... 20 2008 005 354 U

(51) Int. Cl.
*F25D 23/10* (2006.01)
*E06B 7/36* (2006.01)
*F25D 23/02* (2006.01)

(52) U.S. Cl.
CPC . *F25D 23/10* (2013.01); *E06B 7/36* (2013.01); *F25D 23/028* (2013.01)

(58) Field of Classification Search
CPC ..... F25D 23/10; F25D 23/02; F25D 23/028; E05Y 2900/31; E05Y 2900/302; E06B 7/367; E06B 7/36; E06B 7/362; Y10T 16/533; E05D 11/0054
USPC ..... 312/405, 326, 329, 109, 204, 265.5, 312/265.6; 49/504, 501, 70, 463, 383, 384; 16/250
See application file for complete search history.

(56) References Cited

U.S. PATENT DOCUMENTS

| | | | | | |
|---|---|---|---|---|---|
| 2,557,716 | A | * | 6/1951 | Allee | 16/250 |
| 2,681,480 | A | * | 6/1954 | Dixon, Sr. | 49/383 |
| 2,694,234 | A | * | 11/1954 | Roby et al. | 49/383 |
| 2,747,237 | A | * | 5/1956 | Du Plessis | 49/383 |
| 2,995,785 | A | * | 8/1961 | Hallenbeck | 49/383 |
| 3,301,622 | A | * | 1/1967 | Zlatko et al. | 312/245 |
| 3,380,615 | A | * | 4/1968 | Kessler | 220/592.06 |
| 3,435,574 | A | * | 4/1969 | Hallock | 52/278 |
| 3,635,536 | A | * | 1/1972 | Lackey et al. | 312/405 |
| 4,070,074 | A | * | 1/1978 | Rohme | 312/245 |
| 4,741,127 | A | * | 5/1988 | Bockwinkel | 49/501 |
| 4,878,267 | A | * | 11/1989 | Roach et al. | 16/250 |
| 4,948,206 | A | * | 8/1990 | Fitzpatrick | 312/296 |
| 5,115,597 | A | * | 5/1992 | Tillery et al. | 49/504 |
| 5,117,587 | A | * | 6/1992 | Doan | 49/495.1 |
| 5,220,708 | A | * | 6/1993 | Lucas | E06B 7/367 16/225 |
| 5,259,162 | A | * | 11/1993 | Nicholas | 52/463 |
| 5,265,954 | A | * | 11/1993 | Keil | 312/405 |
| 5,359,812 | A | * | 11/1994 | Mayfield | 49/383 |
| 5,417,029 | A | * | 5/1995 | Hugus et al. | 52/792.1 |
| 5,584,551 | A | * | 12/1996 | Jenkins | 312/401 |
| 5,699,676 | A | * | 12/1997 | Trulaske, Sr. | 62/264 |
| 5,720,536 | A | * | 2/1998 | Jenkins et al. | 312/406.2 |

(Continued)

FOREIGN PATENT DOCUMENTS

DE 102005057133 A1 6/2007

*Primary Examiner* — Janet M Wilkens
*Assistant Examiner* — Hiwot Tefera
(74) *Attorney, Agent, or Firm* — Nixon & Vanderhye P.C.

(57) ABSTRACT

With a domestic appliance comprising a carcass (1), a door (2) hinged to the carcass (1) and a frame (8, 9, 10) fastened to the carcass (1) and surrounding the edges of the door (2), a foliate anti-trap element (17) extends from the door (2) through a recess (12) of the frame (8, 9, 10) to a hinge-side side wall (11) of the carcass (1).

20 Claims, 3 Drawing Sheets

(56) References Cited

U.S. PATENT DOCUMENTS

| | | | | |
|---|---|---|---|---|
| 6,141,909 | A * | 11/2000 | Hanson | 49/303 |
| 6,178,700 | B1 * | 1/2001 | Mayer, Jr. | 49/504 |
| 6,298,605 | B1 * | 10/2001 | Delefosse et al. | 49/383 |
| 6,308,474 | B1 * | 10/2001 | Wilson | E04G 21/30 150/154 |
| 6,434,888 | B1 * | 8/2002 | Shaw et al. | 49/383 |
| 6,497,073 | B2 * | 12/2002 | Webb | 49/383 |
| 6,832,450 | B1 * | 12/2004 | Shaharbani | 49/383 |
| 6,964,131 | B2 * | 11/2005 | Herrmann et al. | 49/193 |
| 7,194,792 | B2 * | 3/2007 | Grace et al. | 29/434 |
| 7,712,257 | B2 * | 5/2010 | Johnson | 49/383 |
| 8,104,143 | B2 * | 1/2012 | Heger et al. | 16/347 |
| 2004/0041503 | A1 * | 3/2004 | Lee | 312/406 |
| 2004/0222725 | A1 * | 11/2004 | Park et al. | 312/405 |
| 2005/0006997 | A1 * | 1/2005 | Yoshioka | 312/405 |
| 2006/0103282 | A1 * | 5/2006 | Avendano et al. | 312/401 |
| 2006/0260207 | A1 * | 11/2006 | Chang | 49/504 |
| 2008/0042537 | A1 * | 2/2008 | Kim et al. | 312/405 |
| 2008/0189909 | A1 * | 8/2008 | Heger et al. | 16/347 |
| 2008/0263962 | A1 * | 10/2008 | Wei | 49/462 |
| 2010/0031580 | A1 * | 2/2010 | Lee et al. | 49/504 |
| 2010/0244646 | A1 * | 9/2010 | Laible et al. | 312/405 |
| 2010/0257788 | A1 * | 10/2010 | McRoskey | 49/383 |

* cited by examiner

REFRIGERATOR WITH FRAMED DOOR

BACKGROUND OF THE INVENTION

The present invention relates to a built-in refrigerator, the door of which, when assembled, is enclosed on several sides by a fixed frame. Refrigerators of this type, in which brackets of the frame are fastened in each instance to side walls or a ceiling of the carcass and extend outwards to front edges of the walls of a unit recess surrounding the refrigerator, in order to conceal a gap between the refrigerator and the walls of the recess, are marketed in particular in America.

The fixed frame surrounding the door restricts the freedom of movement of the door, so that the use of multi-joint hinges is generally necessary in order to control an opening movement of the door originating from the frame, without the door striking the frame. If, when opening the door, a gap appears between said door and the frame, said gap being wide enough to insert a finger, there is a risk of injury to fingers when closing the door.

To eliminate this risk of injury, the unexamined German application DE 10 2005 057 133 A1 proposes fastening a flexible covering element to the device door, which engages into a gap in a moveable fashion between opposite side walls of the carcass and the unit recess accommodating the device. This covering element blocks the gap between the device door and the adjacent furniture front when the device door is open and thus eliminates the risk of trapped fingers. The use of such a covering element is however excluded if a fixed frame is fastened to the side wall of the domestic appliance as described in the introduction, since in accordance with DE 10 2005 057 133 A1 this frame occupies the space required for the covering element.

BRIEF SUMMARY OF THE INVENTION

The object of the present invention is to create an effective anti-trap protection for a domestic appliance comprising a framed door of the type described in the introduction.

The object is achieved with a domestic appliance comprising a carcass, a door hinged to the carcass and a frame fastened to the carcass and surrounding edges of the door, by a leaf-type anti-trap element, which extends from the door to a hinge-side side wall of the carcass, crossing a recess of the frame.

This recess can be formed as a slot in the frame. It is however preferable for the recess to be open at a rear edge of the frame in the depth direction of the refrigerator and for said recess, together with the hinge-side side wall of the refrigerator, to restrict the slot crossed by the anti-trap element.

In the interests of the stability of the frame, the slot is preferably closed at both ends.

To offer an effective protection, the slot is to extend between the head and knee height of a user, so that the anti-trap element can be effective at any height, at which a finger of the user can be located under normal circumstances.

If the door includes a door leaf in a manner known per se, said door leaf being held between multi-joint hinges attached to its upper and lower edge, although the slot is to extend continuously across the height of the door leaf, it does not need to reach across it since when the door is open, a hinged bracket of at least one of the multi-joint hinges can block a gap between the door and the frame and can thus prevent a finger from entering.

The door preferably also includes a décor panel superimposed onto the door leaf. The anti-trap element can then engage into a gap between the door leaf and the décor panel and is preferably fastened into this gap.

BRIEF DESCRIPTION OF THE DRAWINGS

Further features and advantages of the invention result from the following description of exemplary embodiments with reference to the appended figures, in which.

DETAILED DESCRIPTION OF EXEMPLARY EMBODIMENTS OF THE PRESENT INVENTION

Figure 1:
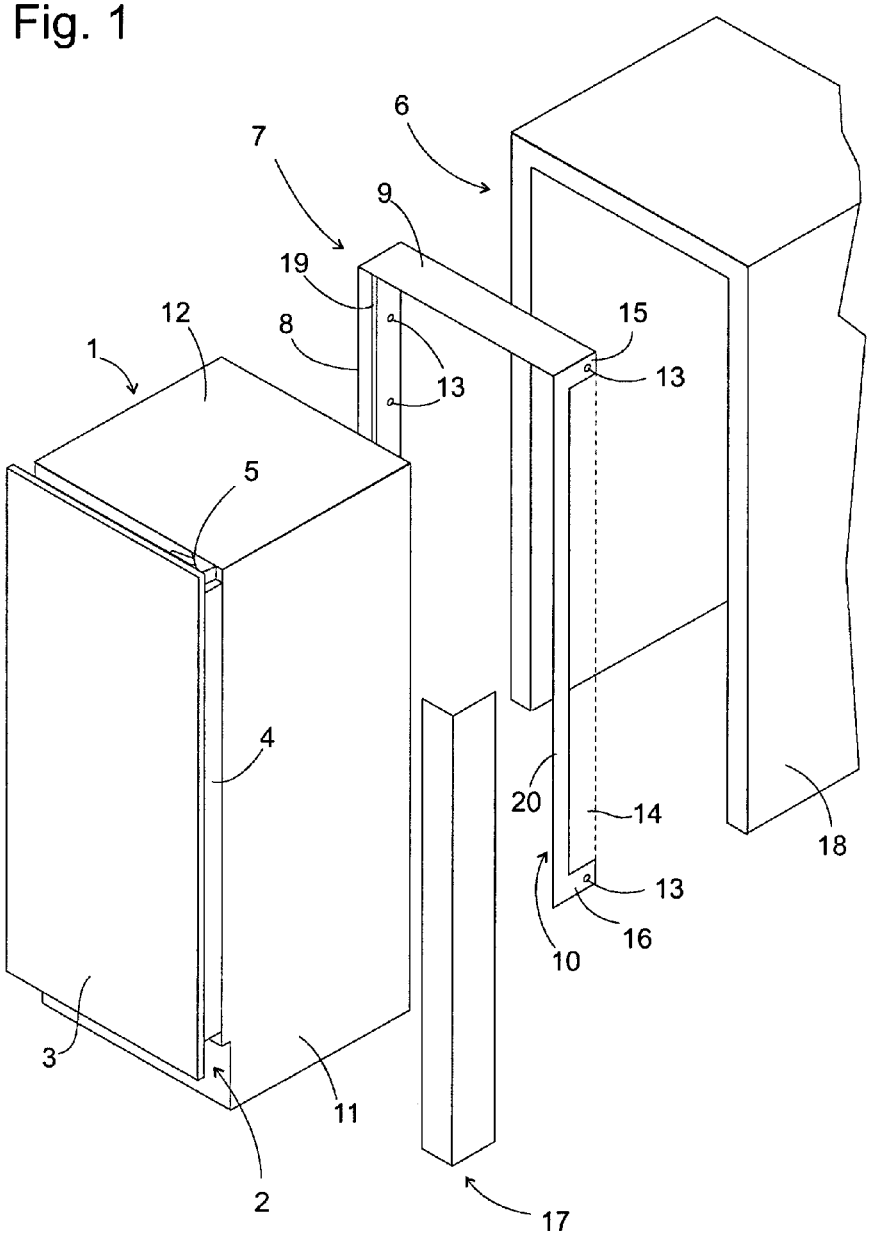
FIG. 1 shows an exploded view of a refrigerator according to the present invention and a unit recess accommodating the same.

FIG. 1 shows a perspective view of a built-in refrigerator comprising a carcass 1 and a door 2, which is assembled from a décor panel 3 and a door leaf 4 largely concealed behind the décor panel in the Figure. The door leaf 4 is embodied in a manner known per se as an essentially plate-like hollow body which is packed with foam insulation material, said hollow body essentially resting in an air-tight fashion against a front side of the carcass 1 when in the closed position and delimiting a cooled interior together therewith.

The door leaf 4 is connected to the carcass 1 by means of two multi-joint hinges 5, which on the one hand attach to the front side of the carcass 1 and on the other hand to an upper and/or lower narrow side of the door leaf 4. The multi-join hinges 5 are essentially also concealed behind the décor panel 3, so that only part of the upper multi-joint hinge 5 can be seen.

The décor panel 3 made of wood or another conventional furniture material is adjusted in terms of its outer appearance to fronts of kitchen units or other devices (not shown), which surround the unit recess accommodating the refrigerator.

A frame 7 includes three profile sections 8, 9, 10 made of extruded aluminum profile for instance, which are provided in order to be mounted on the side walls 11 or ceiling 12 of the carcass 1, protruding a certain extent beyond the front face of the carcass so that a front edge of the frame 7 surrounds the decor panel 3 on its lateral and upper edges. The profile section 8 provided for attachment to the side wall 11 of the carcass 1 facing away from the hinges 5 is provided with a plurality of screw holes 13, which are used to fasten the profile section 8 onto the side wall 11. A large area of the recess 14 opening to the rear is cut out at the right vertical profile section 10. An upper edge of the recess 14 lies approximately at the height of the upper edge of door leaf 4, so that a fastening guide 15 of the profile section 10 which is present above the recess 14 lies at approximately the height of the upper multi joint hinge 5. A lower fastening guide 16 forms the lower termination of the profile section 10. The guides 15, 16 are each provided with screw holes 13 similar to those of the profile section 8. Corresponding screw holes can also be provided on the upper horizontal profile section 9.

The screw holes 13 are positioned on the profile section 10 such that when they are aligned with tapped holes preformed in the carcass 1, the cut-out profile section 10 and the right, side wall 11 adjacent to the hinges delimit a vertically extended slot. A flat, flexible covering element 17, here in the form of an angular profile made of a flexible polymer material, extends through the thus formed slot to a gap between the decor panel 3 and the door leaf 4. An edge of the covering element 17 is clamped into this gap or fastened in another fashion. If the refrigerator is positioned in the unit recess 6, the opposite edge of the covering element 17 engages into a gap between the right side wall 11 of the carcass and a side wall 18 of the unit recess lying opposite thereto.

Figure 2:
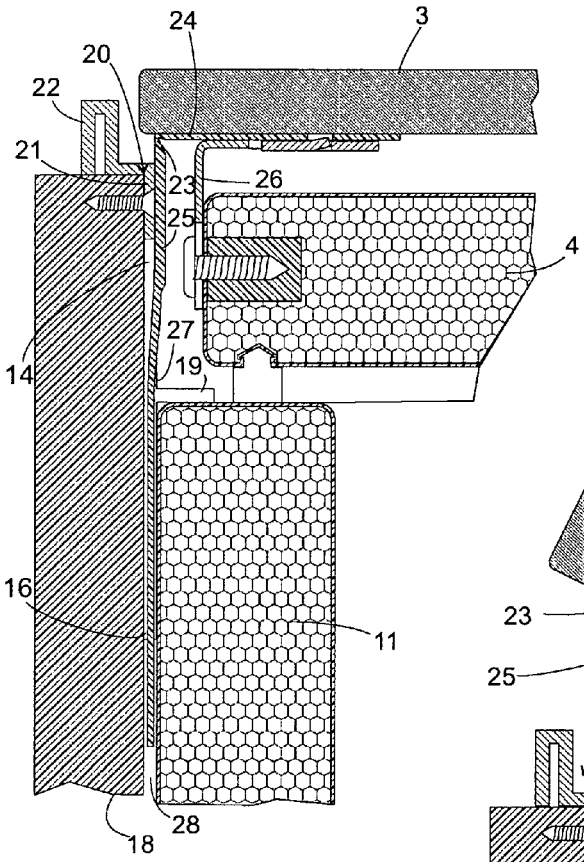
FIG. 2 shows a partial section through the housing of the refrigerator and furniture parts surrounding the same in the case of a closed door.

FIG. 2 shows this actual situation more precisely with the aid of a horizontal section through the front right corner of the refrigerator and the side wall 18. The sectional plane runs at the height of the recess 14, it is however apparent that the carcass 1 is positioned in the recess such that the guides 15, 16 fastened to the side wall 11 outside the sectional plane also touch the side wall 18 of the recess 6 and, just like the profile sections 8, 9, comprise an angular bar 19 functioning as a depth stop.

A bar 20 of the profile section 10 present at the height of the recess 14 has a section 22 which rests internally against the side wall 18, and for stabilization purposes rests against this screwed side and is laterally offset against the side 18 and extends out beyond the front edge of the side wall 18, said section 22 laterally enclosing the decor panel 2 and being partly formed by a U-shaped hollow profile 21.

The bracket 24 is clamped between the décor panel 3 and an angular profile 26 connecting the décor panel to the door leaf 4 by the two brackets 24, 25 of the covering element 17 which are connected by means of a film hinge 23. The second bracket 25 crosses the slot 27 delimited by the bar 20 and the front edge of the side wall 11 and extends into the gap 28 kept free by the guides 15,16 between the side walls 11, 18.

Figure 3:
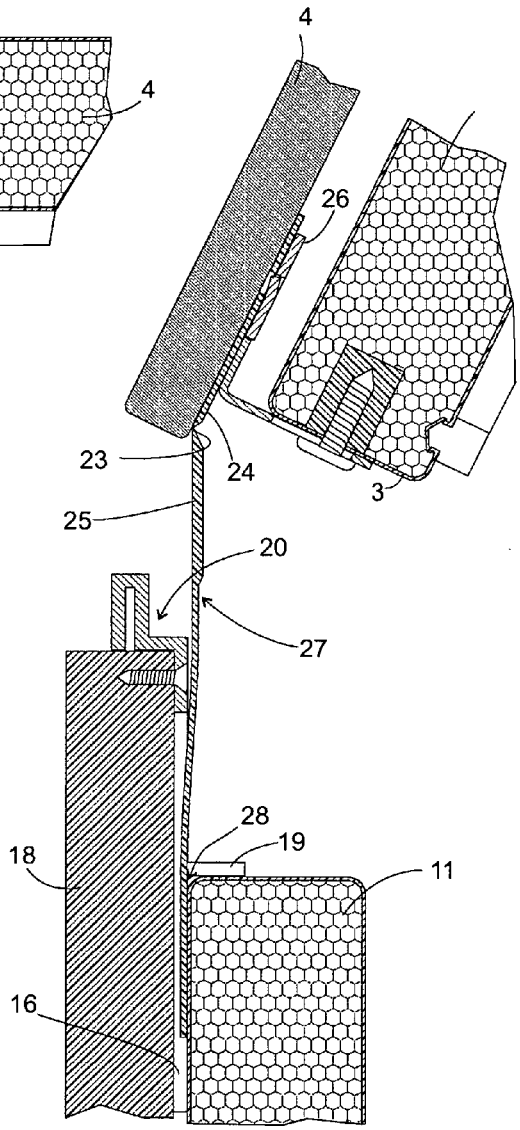
FIG. 3 shows a step similar to FIG. 2 with an open door.
Figure 4:
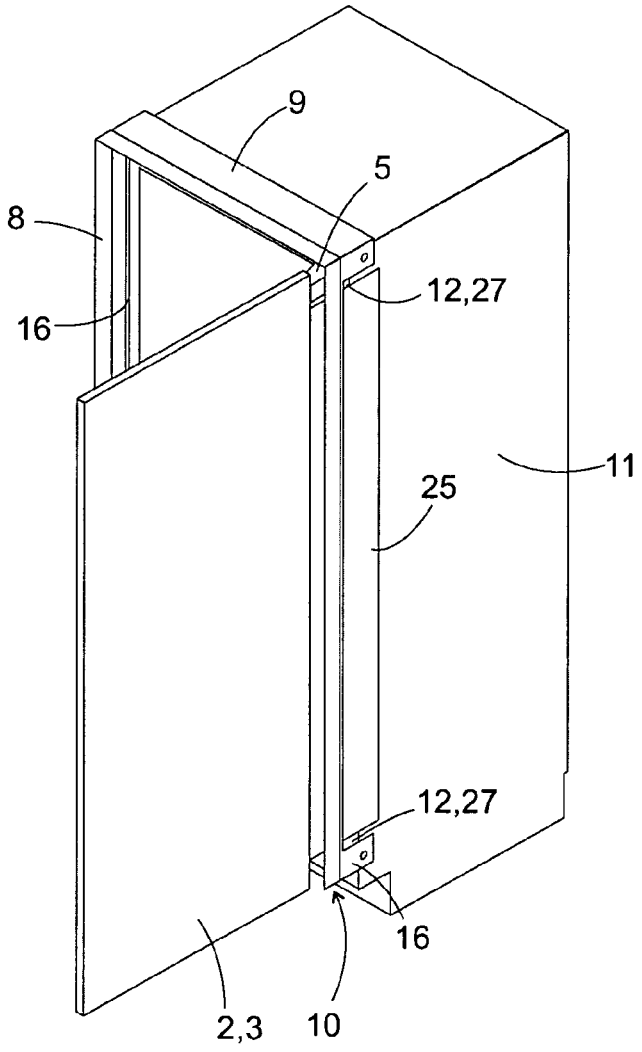
FIG. 4 shows a perspective view of the refrigerator with an assembled frame with an open door.

When the door is opened, as shown in FIGS. 3 and 4, the decor panel 3 is pushed forward out of the enclosure of the right and left profile sections 8, 10 and a gap formed as a result between the bar 20 and the edge of the décor panel 3 facing it is blocked by the bracket 25 of the covering element 17.

The invention claimed is:

1. A refrigerator, comprising:

a carcass;

a door hinged to the carcass and forming a lateral gap with the carcass, the lateral gap extending from an exterior surface of a hinge-side side wall when the door is open;

a frame fastened to the carcass and surrounding at least one edge of the door;

the frame including a limiting structure to restrict freedom of movement of the door when moved to an open position; and a foliate anti-trap element that extends from the door to the hinge-side side wall of the carcass and passes through a recess of the frame, the anti-trap element being configured to block a user's fingers from an exterior side of the door into the lateral gap.

2. The refrigerator of claim 1, wherein the recess of the frame forms a slot.

3. The refrigerator of claim 1, wherein the recess is open at a rear edge of the frame in a depth direction of the refrigerator and with the hinge-side side wall delimiting a slot crossed by the anti-trap element.

4. The refrigerator of claim 2, wherein the slot is closed at both ends.

5. The refrigerator of claim 2, wherein the door includes a door leaf, which is held between multi joint hinges attached to upper and lower edges of the door, and wherein the slot extends continuously across the height of the door leaf.

6. The refrigerator of claim 5, further comprising a hinged bracket of one of the multi joint hinges that blocks a gap between the door and the frame when the door is open.

7. The refrigerator of claim 6, wherein the recess ends at a height of the multi joint hinge.

8. The refrigerator of claim 5, wherein the door includes a decor panel superimposed onto the door leaf.

9. The refrigerator of claim 7, wherein the anti-trap element engages into a gap between the door leaf and the decor panel.

10. The refrigerator of claim 1, wherein the limiting structure includes a section that is adapted to rest against a unit recess sized to receive the refrigerator.

11. A refrigerator, comprising:

a carcass including a hinge-side side wall;

a door hinged to the carcass and forming a lateral gap with the carcass, the lateral gap extending from an exterior surface of the hinge-side side wall when the door is open;

a profile section fastened to an exterior surface of the carcass, the profile section at least partly delimiting a vertically extending slot; and a cover to block a user's fingers from being inserted from an exterior side of the door to the lateral gap, the cover having a first portion clamped or otherwise fastened to the door and a second portion positioned adjacent an exterior surface of the hinge-side side wall, the cover passing through the slot and being positioned adjacent an inside-facing surface of the profile section.

12. The refrigerator of claim 11, wherein the slot is open at a rear edge of the profile section in a depth direction of the refrigerator, the hinge-side side wall delimiting the slot through which the cover passes.

13. The refrigerator of claim 11, wherein the slot is closed at both ends.

14. The refrigerator of claim 11, wherein the door includes a door leaf, which is held between multi joint hinges attached to upper and lower edges of the door, and wherein the slot extends continuously across the height of the door leaf.

15. The refrigerator of claim 14, further comprising a hinged bracket of one of the multi joint hinges that blocks a gap between the door and the profile section when the door is open.

16. The refrigerator of claim 14, wherein the slot ends at a height of the multi joint hinge.

17. The refrigerator of claim 14, wherein the door includes a decor panel superimposed onto the door leaf.

18. The refrigerator of claim 17, wherein the cover engages into a gap between the door leaf and the decor panel.

19. The refrigerator of claim 11, wherein the profile section includes limiting structure configured and positioned to restrict movement of the door.

20. The refrigerator of claim 11, wherein the profile section has a U-shape, with two end portions fastened to the exterior surface of the carcass, and a middle section protruding from the exterior surface of the carcass so as to define the slot.

* * * * *